US006822613B2

(12) United States Patent
Kubota

(10) Patent No.: US 6,822,613 B2
(45) Date of Patent: Nov. 23, 2004

(54) HIGH FREQUENCY WAVE GLASS ANTENNA FOR AN AUTOMOBILE

(75) Inventor: Masato Kubota, Aichi (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/611,891

(22) Filed: Jul. 3, 2003

(65) Prior Publication Data

US 2004/0008144 A1 Jan. 15, 2004

(30) Foreign Application Priority Data

Jul. 3, 2002 (JP) ..... 2002-194886

(51) Int. Cl.[7] ..... H01Q 1/32
(52) U.S. Cl. ..... 343/713; 343/846
(58) Field of Search ..... 343/711, 713, 343/866, 867, 846

(56) References Cited

U.S. PATENT DOCUMENTS

| | | | | | |
|---|---|---|---|---|---|
| 4,967,202 | A | * | 10/1990 | Shinnai et al. | 343/713 |
| 5,334,989 | A | * | 8/1994 | Nagayama et al. | 343/713 |
| 5,353,039 | A | * | 10/1994 | Tsukada et al. | 343/713 |
| 5,905,470 | A | * | 5/1999 | Fujii et al. | 343/713 |
| 6,057,803 | A | * | 5/2000 | Kane et al. | 343/713 |
| 6,072,435 | A | * | 6/2000 | Terashima et al. | 343/713 |
| 6,215,450 | B1 | * | 4/2001 | Oka | 343/713 |
| 6,396,445 | B1 | * | 5/2002 | Saitoh et al. | 343/713 |

FOREIGN PATENT DOCUMENTS

| | | |
|---|---|---|
| JP | 6-152216 | 5/1994 |
| JP | 6-204727 | 7/1994 |
| JP | 6-232617 | 8/1994 |
| JP | 7-162219 | 6/1995 |
| JP | 7-240614 | 9/1995 |
| JP | 8-84012 | 3/1996 |
| JP | 9-321520 | 12/1997 |
| JP | 10-65429 | 3/1998 |
| JP | 10-322117 | 12/1998 |
| JP | 11-74714 | 3/1999 |
| JP | 2000-151249 | 5/2000 |
| JP | 2000-174528 | 6/2000 |
| JP | 2000-216613 | 8/2000 |
| JP | 2001-102836 | 4/2001 |
| JP | 2001-127519 | 5/2001 |
| JP | 2001-144518 | 5/2001 |

* cited by examiner

*Primary Examiner*—Tan Ho
(74) *Attorney, Agent, or Firm*—Oblon, Spivak, McClelland, Maier & Neustadt, P.C.

(57) ABSTRACT

A power feeding point and a grounded point are located in the vicinity of a peripheral portion of a glass sheet for a window; the primary antenna conductor extends in a counterclockwise direction, beginning at the power feeding point, so that the glass sheet has a substantial center located inside the primary antenna conductor; two portions of the primary antenna conductor are connected by a loop-forming conductor to form a loop conductor by the primary antenna conductor and the loop-forming conductor; and the grounding conductor is located near to and capacitively coupled with the primary antenna conductor and the loop-forming conductor.

20 Claims, 8 Drawing Sheets

HIGH FREQUENCY WAVE GLASS ANTENNA FOR AN AUTOMOBILE

BACKGROUND OF THE INVENTION

1. Field of the Invention

The present invention relates to a high frequency wave glass antenna for an automobile, which is suitable for receiving signals in the FM broadcast band (76 to 90 MHz) in Japan or in the FM broadcast band (88 to 108 MHz) in USA. Hereinbelow, the FM broadband in Japan and the FM broadband in USA will be simply referred to as the FM broadcast band.

2. Discussion of Background

A high frequency wave glass antenna for an automobile, which is provided on the glass sheet 1 for a rear side window of an automobile to receive broadcast signals as shown in FIG. 2, has been employed. In FIG. 2, the glass sheet 1 has an antenna conductor 23 and a power feeding point 23*a* provided thereon. The antenna conductor 23 is made of a conductive pattern, which is prepared by, e.g., a method to print paste containing electrically conductive metallic materials, such as electrically conductive silver paste, on an interior side of the glass sheet 1 and to bake the printed paste. The antenna conductor is utilized as an antenna.

In the conventional glass antenna, signals received by the antenna conductor 23 are transmitted from the power feeding point 23*a* to a preamplifier for FM (not shown) through a coaxial cable (not shown). The preamplifier amplifies the received signals and transmits the amplified signals to a receiver (not shown). The antenna conductor 23 serves as not only an antenna for the FM broadcast band but also an antenna for an AM broadcast band.

When receiving signals, the high frequency wave glass antenna for an automobile shown in FIG. 2 serves as a monopole antenna for transmitting the received signals at the power feeding point to the receiver. In the high frequency wave glass antenna for an automobile shown in FIG. 2, the coaxial cable has an internal conductor connected to the power feeding point and an outer conductor connected to a metallic automobile body.

The high frequency wave glass antenna for an automobile shown in FIG. 2 has caused a problem that the conductor length is not enough to have good sensitivity to signals in the FM broadcast band. The conventional glass antenna has also caused a problem that visibility is not good since the pattern forming the antenna conductor is provided in the vicinity of the substantially center on the glass sheet 1 for a rear side window.

SUMMARY OF THE INVENTION

It is an object of the present invention to provide a high frequency wave glass antenna for an automobile, which is capable of solving the problems of the conventional antenna stated earlier.

The present invention provides a high frequency wave glass antenna for an automobile, comprising a primary antenna conductor, a grounding conductor, a power feeding point for the primary antenna conductor and a grounded point for the grounding conductor provided on or in a glass sheet of a window of an automobile; wherein the power feeding point and the grounded point are provided so as to be located in the vicinity of a peripheral portion of the glass sheet or an opening edge formed in an automobile body; wherein when seen from an interior side or an exterior side of the automobile, the primary antenna conductor extends in a counterclockwise direction, beginning at the power feeding point; wherein two portions of the primary antenna conductor are connected by a loop-forming conductor to form a loop conductor by the primary antenna conductor and the loop-forming conductor, or a portion of the primary antenna conductor and the power feeding point are connected by a loop-forming conductor to form a loop conductor by the primary antenna conductor, the loop-forming conductor and the power feeding point; and wherein a portion or an entire portion of the grounding conductor is located near to and capacitively coupled with at least one of the primary antenna conductor, the loop-forming conductor and the power feeding point.

The present invention also provides a high frequency wave glass antenna for an automobile, comprising a primary antenna conductor, a grounding conductor, a power feeding point for the primary antenna conductor and a grounded point for the grounding conductor provided on or in a glass sheet of a window of an automobile; wherein the power feeding point and the grounded point are provided so as to be located in the vicinity of a peripheral portion of the glass sheet or an opening edge formed in an automobile body; wherein when seen from an interior side or an exterior side of the automobile, the primary antenna conductor extends in a counterclockwise direction, beginning at the power feeding point; wherein two portions of the primary antenna conductor are connected by a first loop-forming conductor to form a loop conductor by the primary antenna conductor and the first loop-forming conductor, or a portion of the primary antenna conductor and the power feeding point are connected by a first loop-forming conductor to form a first loop conductor by the primary antenna conductor, the first loop-forming conductor and the power feeding point; wherein two portions of the primary antenna conductor, which are not contained in the first loop conductor, are connected by a second loop-forming conductor to form a second loop conductor by the primary antenna conductor and the second loop-forming conductor; and wherein a portion or an entire portion of the grounding conductor is located near to and capacitively coupled with at least one of the primary antenna conductor, the first loop-forming conductor, the second loop-forming conductor and the power feeding point.

The present invention also provides a high frequency wave glass antenna for an automobile, comprising a primary antenna conductor, a grounding conductor, a power feeding point for the primary antenna conductor and a grounded point for the grounding conductor provided on or in a glass sheet of a window of an automobile; wherein the power feeding point and the grounded point are provided so as to be located in the vicinity of a peripheral portion of the glass sheet or an opening edge formed in an automobile body; wherein when seen from an interior side or an exterior side of the automobile, the primary antenna conductor is provided so as to extend, in a counterclockwise direction, to at least a lower side of the glass sheet substantially along the peripheral portion of the glass sheet or the opening edge, beginning at the power feeding point; wherein two portions of the primary antenna conductor are connected by a loop-forming conductor to form a loop conductor by the primary antenna conductor and the loop-forming conductor, or a portion of the primary antenna conductor and the power feeding point are connected by a loop-forming conductor to form a loop conductor by the primary antenna conductor, the loop-forming conductor and the power feeding point; and wherein a portion or an entire portion of the grounding conductor, which extends beginning at the grounded point, is located near to and capacitively coupled with at least one of a lower portion of the primary antenna conductor and the loop-forming conductor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
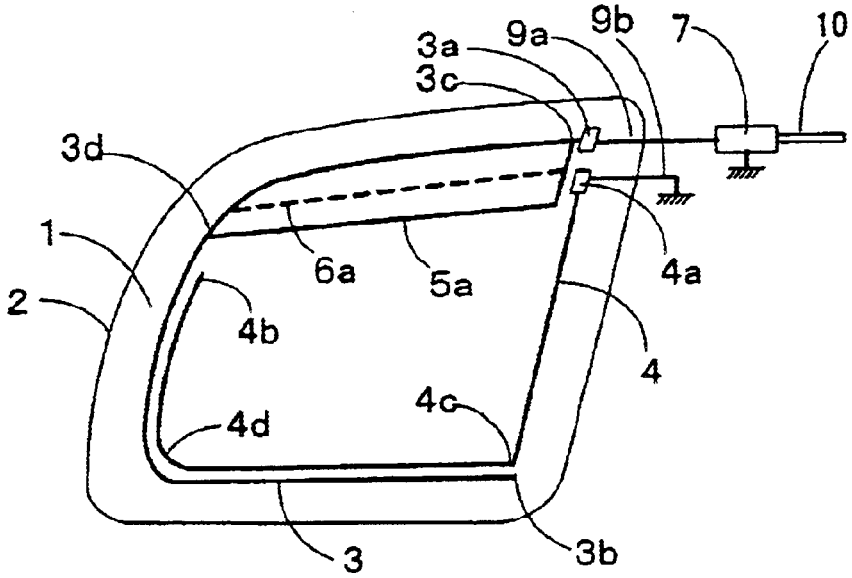
FIG. 1 is a schematic view showing the arrangement of the high frequency wave glass antenna for an automobile according to an embodiment of the present invention.

Now, the present invention will be described in detail, referring to the accompanying drawings. FIG. 1 is a schematic view showing the arrangement of the high frequency wave glass antenna for an automobile according to an embodiment of the present invention. In FIG. 1 and subsequent figures, directions will be referred to with respect to the sheets showing the respective figures.

The glass sheet to be provided with a high frequency wave glass antenna for an automobile according to the present invention may be of any type, such as a glass sheet for a front side window, a glass sheet for a rear side window, a glass sheet for a front windshield, and a glass sheet for a roof window. In FIG. 1, a glass sheet for a rear side window is shown as a typical example of the glass sheet to be provided with the high frequency wave glass antenna for an automobile. In explanation below, the statement with respect to the glass sheet for a rear side window may be applied to any one of the other glass sheets.

In FIG. 1, reference numeral 1 designates the glass sheet for a rear side window, reference numeral 2 designates an opening edge formed in an automobile body, reference numeral 3 designates a primary antenna conductor, reference numeral 3*a* designates a power feeding point for the primary antenna conductor 3, reference numeral 3*b* designates a leading edge (open edge) of the primary antenna conductor 3, reference numeral 3*c* designates a first portion of the primary antenna conductor 3, reference numeral 3*d* designates a second portion of the primary antenna conductor 3, reference numeral 4 designates a grounding conductor, reference numeral 4*a* designates a grounded point, reference numeral 4*b* designates a leading edge (open end) of the grounding conductor 4, reference numeral 4*c* designates an angularly bent portion of the grounding conductor 4, reference numeral 4*d* designates a curved portion of the grounding conductor 4, reference numeral 5*a* designates a loop-forming conductor, reference numeral 6*a* designates an auxiliary loop-forming conductor (indicated by a dotted line), reference numeral 7 designates a peripheral circuit for the antenna, reference numeral 9*a* designates a lead wire on the side of the power feeding point 3*a*, reference numeral 9*b* designates a lead wire on the side of the grounded point 4*a*, and reference numeral 10 designates a coaxial cable.

In explanation below, directions will be referred to with respect to the sheets showing the respective figures unless otherwise specified. When the arrangement of the primary antenna conductor 3, the power feeding point 3*a*, the grounding conductor 4 and the grounded point 4*a* according to the present invention is explained, the peripheral edge of the glass sheet 1, instead of the opening edge, will be mainly referred to. This is because the opening edge 2 normally has a slightly smaller size than the peripheral edge of the glass sheet 1 (normally by several cm), and because the opening edge has a shape defined in accordance with the peripheral edge of the glass sheet 1.

In the present invention, the primary antenna conductor 3, the grounding conductor 4, the feeding point 3*a* and the grounded point 4*a* are provided on the glass sheet 1. The feeding point 3*a* and the grounded point 4*a* are provided in the vicinity of the opening edge 2 formed in the automobile body.

The primary antenna conductor 3 begins at the power feeding point 3*a* and extends in a counterclockwise direction so that the substantial center of the glass sheet 1 is located inside the primary antenna conductor. In the embodiment shown in FIG. 1, the primary antenna conductor 3 begins at the power feeding point 3*a* and extends to a lower side of the opening edge 2 in the counterclockwise direction substantially along the peripheral edge of the glass sheet 1. The leading edge 3*b* of the primary antenna conductor 3 reaches in the vicinity of a lower right corner of the opening edge 2.

The present invention is not limited to this arrangement. The present invention is operable as long as the primary antenna conductor 3 extends to a left side of the opening edge 2.

In the embodiment shown in FIG. 1, two portions of the first portion 3*c* and the second portion 3*d* of the primary antenna conductor 3 are connected by the loop-forming conductor 5*a* so that the primary antenna conductor 3 and the loop-forming conductor 5*a* form a loop conductor. However, the present invention is not limited to this arrangement. Two points of the power feeding point 3*a* and the second portion 3*d* may be connected by the loop-forming conductor 5*a* so that the primary antenna conductor 3, the power feeding point 3*a* and the loop-forming conductor 5*a* form a loop conductor. The embodiment shown in FIG. 1 is helpful to improve the sensitivity to frequencies in the middle and high ranges in a desired frequency band to be received. The auxiliary loop-forming conductor 6*a* may be provided, as required, to connect between a portion of the primary antenna conductor 3 and a portion of the loop-forming conductor 5*a*. The reason why the auxiliary loop-forming conductor is provided will be described later.

When the power feeding point 3*a* and the second portion 3*d* is connected by the loop-forming conductor 5*a*, a portion of the primary antenna conductor 3 or a portion of the loop-forming conductor 5*a* may be connected with the power feeding point by the auxiliary loop-forming conductor 6*a*.

The reason why the loop conductor is provided in the present invention is as follows: It is normally difficult to use a single glass antenna to cover all ranges in a desired frequency band to be received. When an attempt is made to increase the sensitivity to frequencies close to the center of a desired frequency band to be received, the sensitivity to frequencies in a low range or a high range in the desired frequency band lowers.

Suppose that the primary antenna conductor 3 is divided into two halves of an area close to the power feeding point 3*a* and an area close to the leading edge 3*b* in the present invention, the provision of a loop conductor in the area close to the power feeding point 3*a* can contribute to improvement in the sensitivity to frequencies in the high range in the desired frequency band. The provision of a loop conductor provided in the area close to the leading edge 3*b* can contribute to improvement in the sensitivity to frequencies in the low range in the desired frequency band.

In the present invention, the auxiliary loop-forming conductor is provided as required. The auxiliary loop-forming conductor connects between two portions of the loop conductor. When a single auxiliary loop-forming conductor is provided, the loop conductor is divided into two parts, forming two loop conductors. A plurality of auxiliary loop-forming conductors may be provided. When a plurality of auxiliary loop-forming conductors are provided, an additional auxiliary loop-forming conductor may connect between two portions of the loop conductor, between a portion of the already provided auxiliary loop-forming conductor and a portion of the loop conductor, or between two portions of the already provided auxiliary loop-forming conductor. The provision of an auxiliary loop-forming conductor can contribute to improvement in the sensitivity to frequencies in the low range or the high range in the desired frequency band.

In the present invention, the preferable position of the power feeding point 3*a* on the glass sheet 1 is first a portion of the glass sheet 1 in the vicinity of an upper rear side of the opening edge 2, then a portion of the glass sheet 1 in the vicinity of an upper front side of the opening edge 2*a*, a portion of the glass sheet 1 in the vicinity of an lower rear side of the opening edge 2 and finally a portion of the glass sheet 1 in the vicinity of a lower front side of the opening edge 2 in terms of improvement in the sensitivity.

However, the provision of the power feeding point 3*a* at the portion of the glass sheet 1 in the vicinity of the upper rear side of the opening edge 2 or the portion of the glass sheet 1 close to the lower rear side of the opening edge 2 is disadvantageous since the coaxial cable 10 needs to be long.

Although the grounded point 4*a* is provided substantially under the power feeding point 3*a* in the embodiment shown in FIG. 1, the present invention is not limited to this arrangement. The position on the glass sheet 1 where the grounded point 4*a* is provided may be at least one of a position substantially above the power feeding point 3*a*, and a position on substantially the right side and a position on substantially the left side of the power feeding point 3*a*.

Although it is preferable that the power feeding point 3*a* and the grounded point 4*a* are close to each other to ensure a required length for the grounding conductor 4 as in the embodiment shown in FIG. 1, the present invention is not limited to this arrangement. The present invention is operable even when the power feeding point 3*a* and the grounded point 4*a* are apart from each other.

Figure 12:
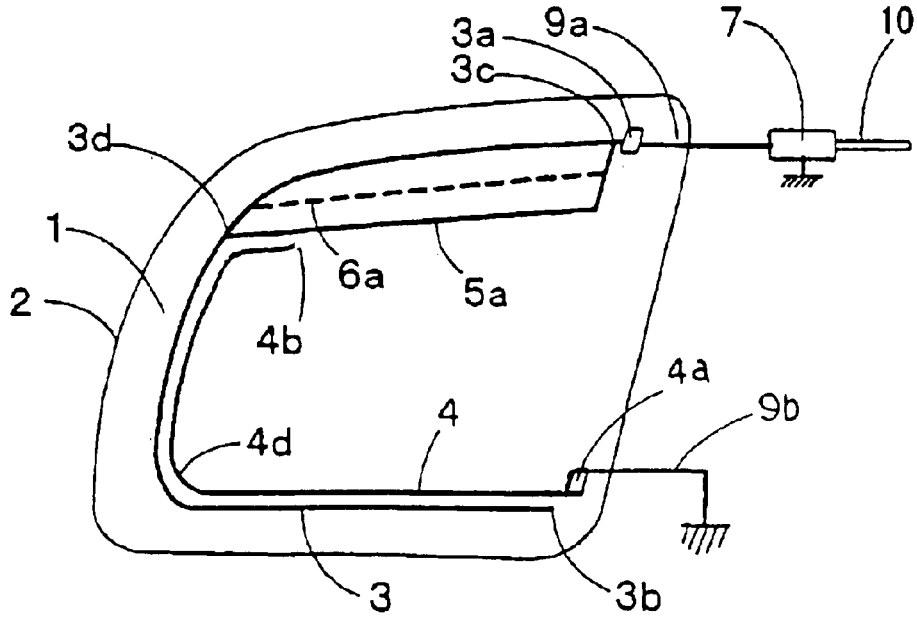
FIG. 12 is a schematic view showing the arrangement of the high frequency wave glass antenna for an automobile according to an embodiment of the present invention different from the embodiment shown in FIG. 1, wherein a power feeding point and a grounded point are apart from each other.

An example of the case wherein the power feeding point 3*a* and the grounded point 4*a* are apart from each other is the embodiment shown in FIG. 12. In the embodiment shown in FIG. 12, the power feeding point 3*a* is located in the vicinity of an upper right corner of the glass sheet 1, and the grounded point 4*a* is located in the vicinity of a lower right corner of the glass sheet 1. The grounding conductor 4 extends from the grounded point 4*a* toward a left direction.

Although the embodiment shown in FIG. 12 is advantageous in that visibility on a right or left side is improved, it becomes difficult to ensure the required length for the grounding conductor 4. A comparison of the embodiment shown in FIG. 1 with the embodiment shown in FIG. 12 indicates that the leading edge 4*b* shown in FIG. 12 is provided at a higher position than the leading edge 4*b* shown in FIG. 1 to ensure the required length for the grounding conductor 4.

In the embodiment shown in FIG. 1, the grounding conductor 4 begins at the grounded point 4*a*, extends to substantially the lower side of the opening edge 2 along a right side of the opening edge 2, is angularly bent at the angularly bent portion 4*c* in the vicinity of the lower right corner of the opening edge 2, extends substantially in a left direction along a lower portion of the primary antenna conductor 3, is curved at the curved portion 4*d* and extends substantially upward. The leading edge 4*b* of the grounding conductor reaches in the vicinity of the second portion 3*d*.

In the embodiment shown in FIG. 1, the glass sheet 1 is formed in a substantially parallelogram shape. The present invention is not limited to this arrangement. The glass sheet 1 may be formed in a substantially trapezoidal shape, a substantially square shape, such as a lozenge, a substantially polygonal shape, a substantially triangular shape, a substantially circular shape, a substantially elliptic shape, or another shape.

In the embodiment shown in FIG. 1, portions of the grounding conductor 4 (a portion of the grounding conductor 4 in the vicinity of the lower side of the opening edge 2 and a portion of the grounding conductor 4 in the vicinity of the left side of the opening edge 2) are located near to portions of the primary antenna conductor 3 in the vicinity of the lower side of the opening edge 2 and in the vicinity of the left side of the opening edge 2 to provide capacitive coupling. The present invention is not limited to this arrangement. The present invention is operable as long as a portion or the entire portion of the grounding conductor 4 is located near to and capacitively coupled with at least one of a portion of the primary antenna conductor 3 in the vicinity of an upper side of the opening edge 2, a portion of the primary antenna conductor 3 in the vicinity of the left side of the opening edge 2, a portion of the primary antenna conductor 3 in the vicinity of the lower side of the opening edge 2, and the loop-forming conductor 5*a*.

Figure 3:
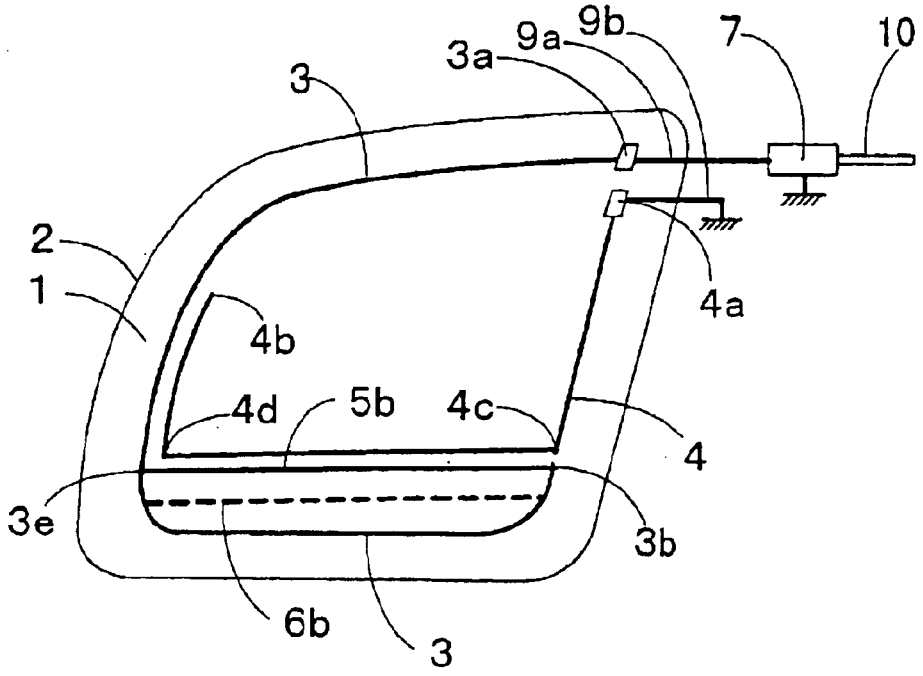
FIG. 3 is a schematic view showing the arrangement of the high frequency wave glass antenna for an automobile according to another embodiment of the present invention.

FIG. 3 is a schematic view of the arrangement of another embodiment, which is different from the embodiment shown in FIG. 1. In the embodiment shown in FIG. 1, the loop-forming conductor 5*a* is provided at a higher position than the substantial center of the glass sheet 1 in the vertical direction. On the other hand, in the embodiment shown in FIG. 3, the loop-forming conductor 5*a* is provided at a lower position than the substantial center of the glass sheet 1 in the vertical direction.

In the embodiment shown in FIG. 3, the primary antenna conductor 3 begins at the power feeding point 3*a* and extends in the counterclockwise direction so that the substantial center of the glass sheet 1 is located inside the primary antenna conductor. The primary antenna conductor further extends to the lower side of the opening edge 2 and additionally extends slightly toward a substantially upward direction in the vicinity of the lower right corner of the opening edge 2.

In the embodiment shown in FIG. 3, the leading edge 3*b* and a portion 3*e* of the primary antenna conductor are connected by a loop-forming conductor 5*b*. The loop-forming conductor 5*b* extends substantially parallel with the lower side of the opening edge 2. The portion 3*e* is located in the vicinity of a lower left corner of the opening edge 2.

In the embodiment shown in FIG. 3, the grounded point 4*a* is provided substantially under the power feeding point 3*a*. The grounding conductor 4 begins at the grounded point 4*a*, extends downwardly along the right side of the opening edge 2, is angularly bent at the angularly bent portion 4*c* in the vicinity of the lower right corner of the opening edge 2, extends substantially in the left direction along the loop-forming conductor 5*b*, is curved at the curved portion 4*d* and extends substantially upward. The leading edge 4*b* of the grounding conductor reaches in the vicinity of an upper left corner of the opening edge 2.

In the embodiment shown in FIG. 3, portions of the grounding conductor 4 (a lower portion and a left portion of the grounding conductor 4) are located near to the loop-forming conductor 5*b* and to a left portion of the primary antenna conductor 3 to provide capacitive coupling. The present invention is not limited to this arrangement. The present invention is operable as long as a portion or the entire portion of the grounding conductor 4 is located near to and capacitively coupled with at least one of an upper portion of the primary antenna conductor 3, the left portion of the primary antenna conductor 3, the lower portion of the primary antenna conductor 3, the loop-forming conductor 5*b*, and the power feeding point 3*a*. The embodiment shown in FIG. 3 is helpful to improve the sensitivity to frequencies in the low range and the middle range in the desired frequency band. In the embodiment shown in FIG. 3 as well, an auxiliary loop-forming conductor 6*b* is provided as required. The auxiliary loop-forming conductor 6*b* connects between two portions of the loop conductor.

Figure 4:
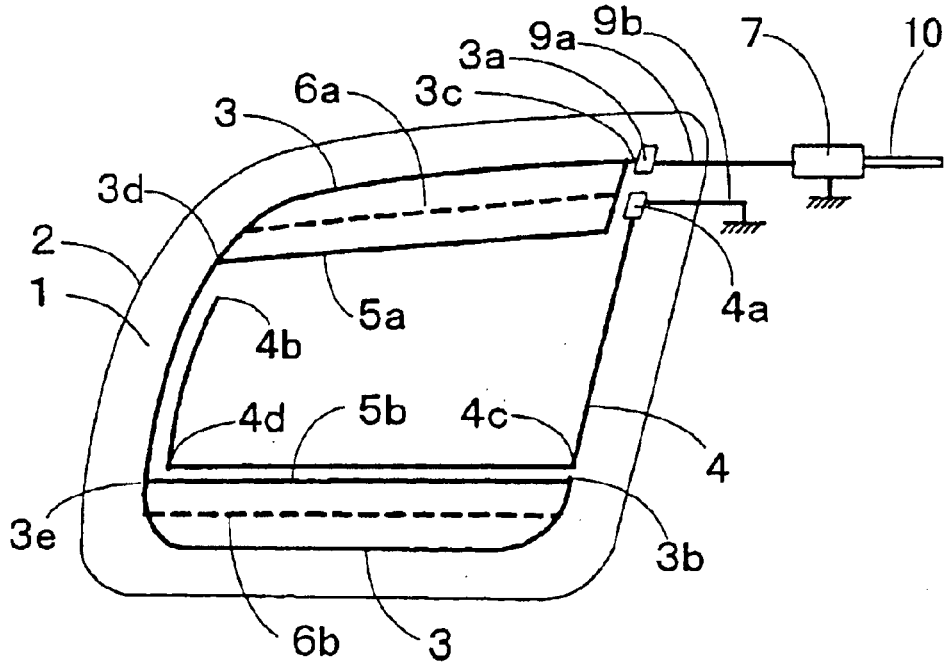
FIG. 4 is a schematic view showing the arrangement of the high frequency wave glass antenna for an automobile according to another embodiment of the present invention.

FIG. 4 is a schematic view of the arrangement of another embodiment, which is different from the embodiment shown in FIG. 3. The embodiment shown in FIG. 4 is directed to a high frequency wave glass antenna for an automobile, which is configured in the same arrangement as the embodiment shown in FIG. 3 except that the loop-forming conductor 5*a* shown in FIG. 1 is added to the embodiment shown in FIG. 3. The embodiment shown in FIG. 4 is helpful to improve the sensitivity to frequencies in the low range, the middle range and the high range in the desired frequency band, exhibiting flat sensitivity-frequency characteristics.

Figure 5:
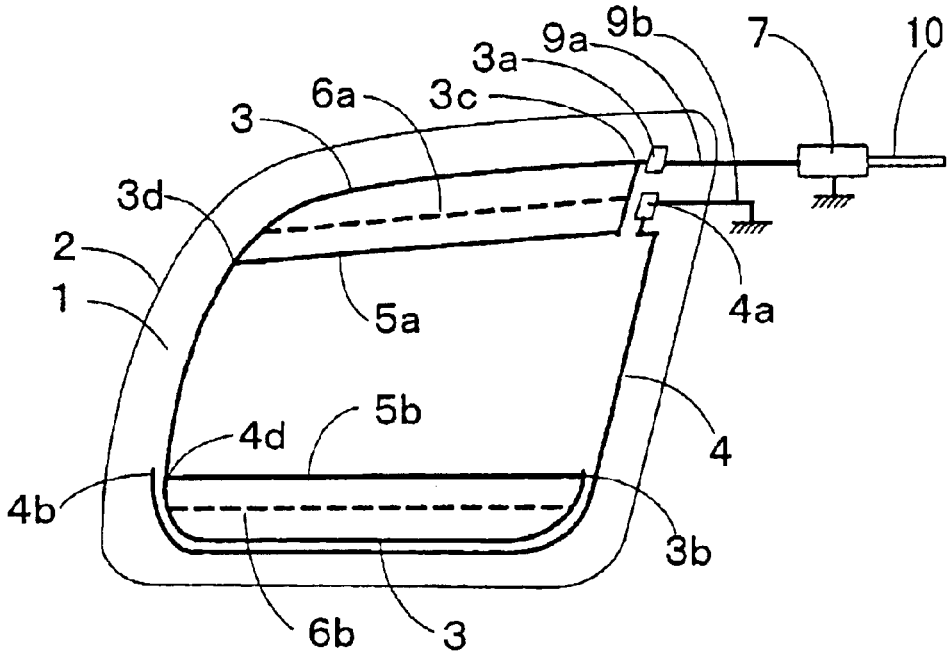
FIG. 5 is a schematic view showing the arrangement of the high frequency wave glass antenna for an automobile according to another embodiment of the present invention.

FIG. 5 is a schematic view of the arrangement of another embodiment, which is different from the embodiment shown in FIG. 4. In the embodiment shown in FIG. 4, the grounding conductor 4 extends in a clockwise direction inside the primary antenna conductor 3. On the other hand, in the embodiment shown in FIG. 5, the grounding conductor 4 extends in the clockwise direction outside the primary antenna conductor 3, and the grounding conductor 4 is mainly capacitively coupled with the lower portion of the primary antenna conductor.

Figure 6:
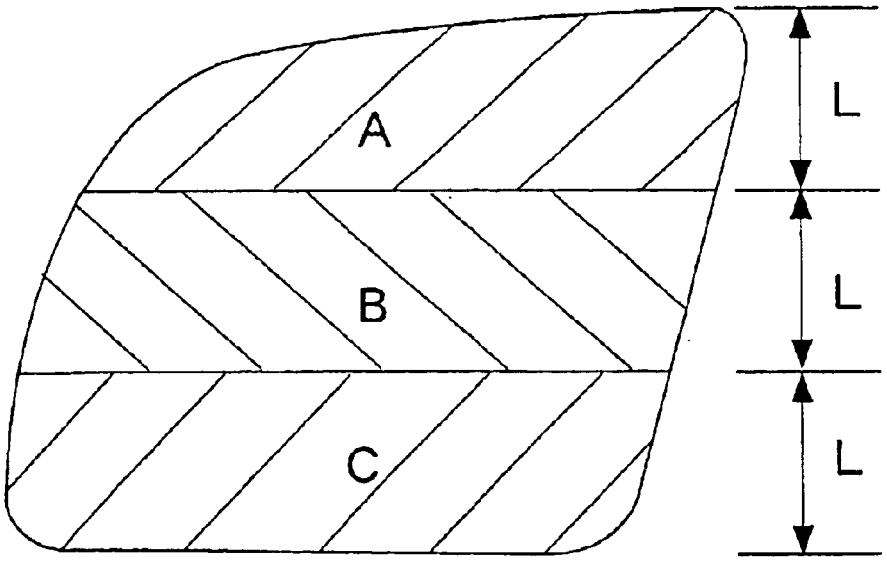
FIG. 6 is a plan view, wherein a glass sheet for a rear side window is divided into three parts with equal intervals L in a vertical direction, and the three parts are called an A region, a B region and a C region from top.

FIG. 6 is a plan view, wherein the glass sheet 1 is divided into three parts with equal intervals L in the vertical direction, and the three parts are called an A region, a B region and a C region from top. In order to maximize visibility, it is preferable that the loop-forming conductor is not provided in the B region in the embodiments shown in FIGS. 1 and 3. In order to maximize visibility, it is preferable that neither the first loop-forming conductor nor the second loop-forming conductor is provided in the B region in the embodiments shown in FIGS. 4 and 5, and in the embodiments shown in FIGS. 7 and 8 explained later.

Figure 7:
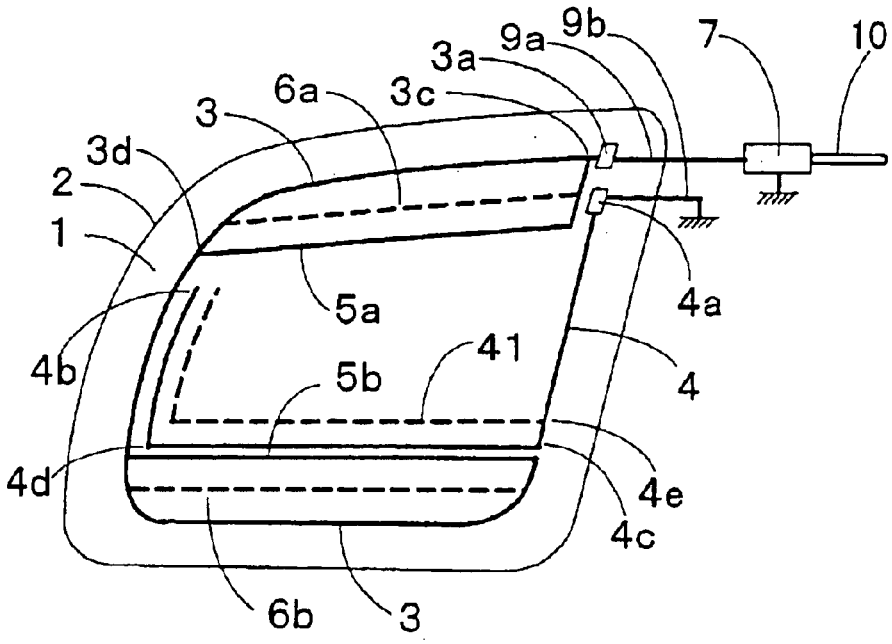
FIG. 7 is a schematic view showing the arrangement of the high frequency wave glass antenna for an automobile according to another embodiment of the present invention.
Figure 8:
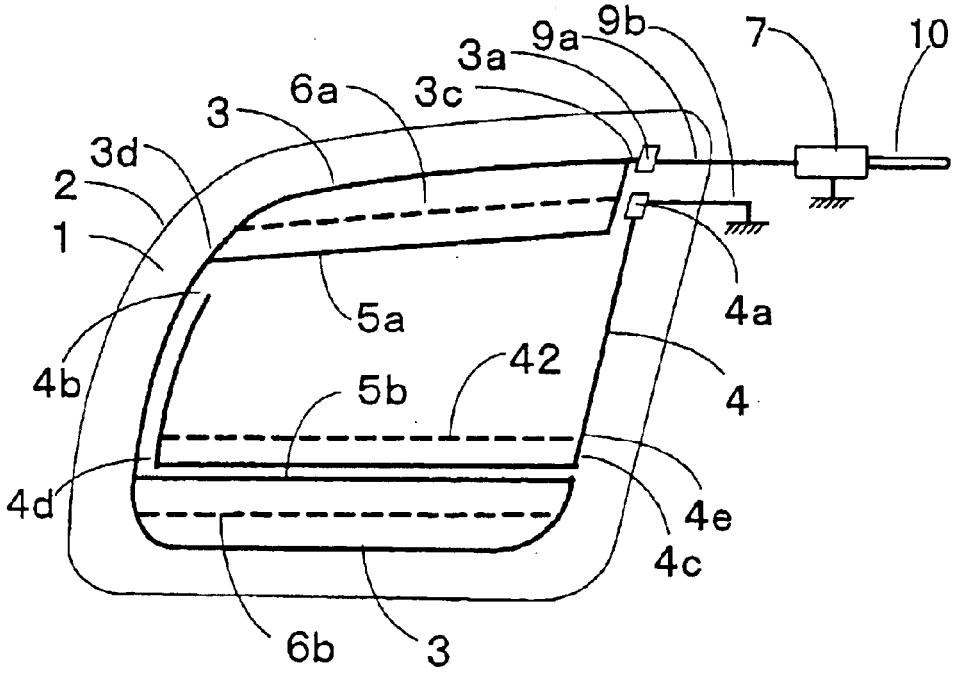
FIG. 8 is a schematic view showing the arrangement of the high frequency wave glass antenna for an automobile according to another embodiment of the present invention.

Each of FIGS. 7 and 8 is a schematic view of the arrangement of another embodiment, which is different from the embodiment shown in FIG. 4. The embodiments shown in FIGS. 7 and 8 are different from the embodiment shown in FIG. 4 in that an auxiliary grounding conductor is additionally provided for the grounding conductor 4 in the embodiment shown in FIG. 4. In the embodiment shown in FIG. 7, the auxiliary grounding conductor 41 begins at a portion of the grounding conductor 4 above a position in the vicinity of the angularly bent portion 4*c*, extends toward the left direction along the lower portion of the grounding conductor 4, is angularly bent in the vicinity of the portion 4*d* and further extend substantially upward. A leading edge of the auxiliary grounding conductor 41 reaches in the second portion 3*d*.

In the embodiment shown in FIG. 8, the auxiliary grounding conductor 42 begins at the portion 4*e* of the grounding conductor 4 and extends toward the left direction along the lower portion of the grounding conductor 4. A leading edge of the auxiliary grounding conductor 42 is connected to the grounding conductor 4. The lower portion of the grounding conductor 4 and the auxiliary grounding conductor 42 form a loop. When the auxiliary grounding conductor 41 or the auxiliary grounding conductor 42 can be additionally provided for grounding conductor 4, improving the sensitivity to frequencies in the entire ranges in the desired frequency bound.

In the present invention, it is preferable that the primary antenna conductor 3 has a conductor length (excluding the power feeding point 3*a*) ranging from $0.7\cdot(1/4)\cdot(\lambda_M+\lambda_L)\times K$ to $1.2\cdot(1/4)\cdot(\lambda_M+\lambda_L)\times K$, wherein the wavelength of the center frequency $F_M$ in the desired frequency band is $\lambda_M$, and the wavelength of the lowest frequency $F_L$ in a desired frequency band to be received is $\lambda_L$. Conductor lengths within this range are more helpful to improve the sensitivity to frequencies in the low range or the middle range in the desired frequency band in comparison with conductor lengths outside this range. In the formula, K is shortening ratio by glass, which is normally 0.64. The center frequency $F_M$ of the FM broadcast band in Japan is 83.0 MHz.

It is preferable that the lead wire 9*a* has a length ranging from 100 to 300 mm, in particular from 150 to 250 mm. When the lead wire 9*a* has a length of not shorter than 100 mm, it becomes easy to mount the lead wire. When the lead wire 9*a* has a length of not longer than 300 mm, S/N ratios are improved, and the frequency-sensitivity characteristics becomes stable.

In the present invention, it is preferable that the grounding conductor 4 has a conductor length ranging from $0.8\cdot(\lambda_M/3)\times K$ to $1.2\cdot(\lambda_M/3)\times K$. The conductor length within this range is more helpful to improve the sensitivity to frequencies in the desired broadcast band in comparison with the conductor length outside this range. It is preferable that the lead wire 9*b* has a length ranging from 100 to 300 mm, in particular from 150 to 250 mm. When the lead wire 9*b* has a length of not shorter than 100 mm, it becomes easy to mount the lead wire 9*b*. When the lead wire 9*b* has a length of not longer than 300 mm, the frequency-sensitivity characteristics becomes stable.

It is preferable that the loop conductor shown in FIG. 1 and the first loop conductor shown in FIG. 3 have a conductor length ranging from $0.6\cdot((\lambda_M+\lambda_H)/4)\times K$ to $1.2\cdot((\lambda_M+\lambda_H)/4)\times K$, wherein the wavelength of the highest frequency $F_H$ in the desired frequency band is $\lambda_H$. Conductor lengths within this range are more helpful to improve the sensitivity to frequencies in the high range in the desired broadcast band in comparison with conductor lengths outside this range.

Figure 2:
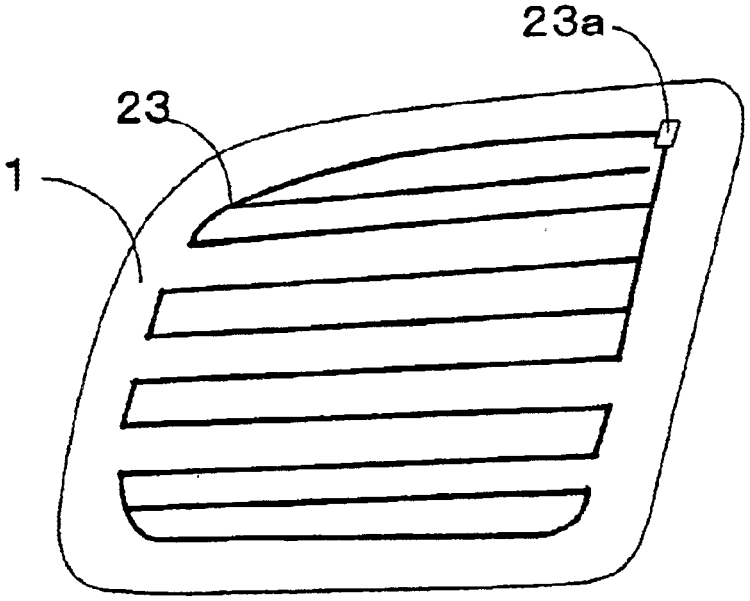
Fig. 2 PRIOR ART
FIG. 2 is a schematic view showing the arrangement of a conventional glass antenna.

It is preferable that the loop conductor shown in FIG. 2 and the second loop conductor shown in FIG. 3 has a conductor length ranging from $0.5\cdot((\lambda_M+\lambda_L)/4)\times K$ to $((\lambda_M+\lambda_L)/4)\times K$.

Conductor lengths within this range are more helpful to improve the sensitivity to frequencies in the low range in the desired frequency band in comparison with conductor lengths outside this range.

In each of the embodiments shown in FIGS. 4, 5, 7 and 8, it is preferable that the primary antenna conductor 3 has a conductor length between the first loop conductor and the second loop conductor (between the portion 3*d* and the portion 3*e*) ranging from $(1/4)\cdot(\lambda_M/4)\times K$ to $(1/2)\cdot(\lambda_M/4)\times K$. Conductor lengths within this range are more helpful to improve flatness in the sensitivity to frequencies in the desired frequency band in comparison with conductor lengths outside this range. The flatness in the sensitivity means the difference between the highest sensitivity and the lowest sensitivity to frequencies in the desired frequency band.

In the present invention, it is preferable that, provided that capacitively coupled portions are short-circuited together, the conductor length of the maximum outer periphery of a conductor connecting between the power feeding point 3*a* and the grounded point 4*a* (e.g., the total length of the conductor length of the primary antenna conductor 3, the conductor length of the grounding conductor 4 from the grounded point 4*a* to the portion 4*c* (excluding the grounded point 4*a*), and the distance between the capacitively coupled portions, provided that the primary antenna conductor 3 and the grounding conductor 4 are short-circuited between the leading edge 3*b* and the portion 4*c* in the embodiment shown in FIG. 4) ranges from $0.8\cdot(\lambda_M/2)\times K$ to $1.4\cdot(\lambda_M/2)\times K$. Conductor lengths within this range are more helpful to improve the sensitivity to frequencies in the desired broadcast band in comparison with conductor lengths outside this range.

In the present invention, it is preferable that the distance between the power feeding point 3*a* and the grounded point 4*a*, the shortest distance between the primary antenna conductor 3 and the grounded point 4*a* and the shortest distance between the loop conductor and the grounded point 4*a* are not shorter than 6.0 mm, in particular not shorter than 10 mm. Distances of not shorter than 6.0 mm are more helpful to improve the sensitivity than distances of shorter than 6.0 mm.

Figure 11:
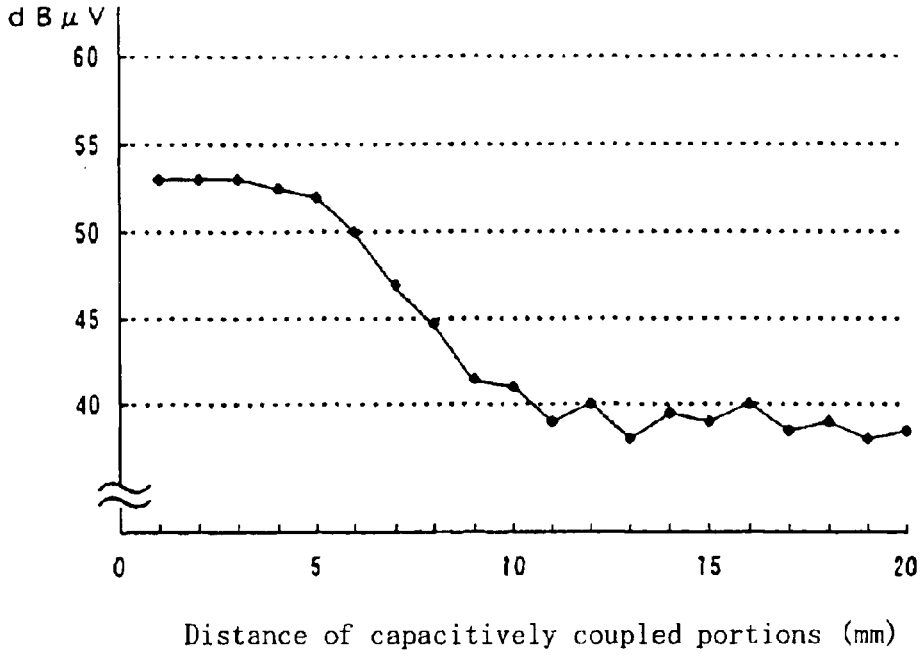
FIG. 11 is a graph showing average sensitivity characteristics in the Japanese FM broadcast band with respect to distances between capacitively coupled portions in Example 2.

In the present invention, it is preferable that the distance of the capacitively coupled portions, such as the distance between the left portion of the primary antenna conductor 3 and the left portion of the grounding conductor 4 in each of the embodiments shown in FIGS. 1, 3, 4, 5, 7 and 8, or distance between the grounding conductor 4 and the loop-forming conductor 5*b* in each of the embodiments shown in FIGS. 3, 4, 6, 7 and 8, and the distance between the lower portion of the primary antenna conductor 3 and the grounding conductor 4 in the embodiment shown in FIG. 5 ranges from 0.5 to 8.0 mm, in particular from 0.5 to 6.0 mm. As shown in FIG. 11 stated later, distances of not shorter than 0.5 mm can reduce danger of short-circuiting since, e.g., metal migration is difficult to cause in the primary antenna conductor, the grounding conductor and the loop-forming conductor. Distances of not longer than 8.0 mm are easy to provide effective capacitive coupling, improving the sensitivity abruptly.

In the present invention, when each of the primary antenna conductor, the grounding conductor and the loop-forming conductor(s) changes its direction, the change in direction may be made by curving or angularly bending the conductor. Although the grounding conductor 4 is angularly bent at the portion 4*c* to change its direction, the grounding conductor may be curved at that portion to change its direction for instance.

With respect to the pattern of the high frequency wave glass antenna for an automobile, FIGS. 1, 3, 4, 5, 7 and 8 show patterns of the glass antenna, which are seen from an interior side. The patterns of the glass antenna are not limited to the ones shown in these figures. The glass antenna may have any one of patterns, which are the same as the ones shown in FIGS. 1, 3, 4, 5, 7 and 8 when seen from an exterior side.

In the present invention, the primary antenna conductor may be provided with one or more loop conductors, in addition to the first loop conductor and the second loop conductor. Although none of the primary antenna conductor, the power feeding point, the grounding conductor, the grounded point, the loop-forming conductor and the auxiliary loop-forming conductor are not provided with an auxiliary conductor in each of the embodiments shown in FIGS. 1, 3, 4, 5, 7 and 8, the present invention is not limited to these arrangements. For phase adjustment and directively adjustment, an auxiliary conductor formed in a substantially T-character shape, a substantially L-character shape, a loop shape or the like may be provided for the primary antenna conductor, the power feeding point, the grounding conductor, the grounded point, the loop-forming conductor or the auxiliary loop-forming conductor.

In the present invention, examples of the desired frequency band are, in addition to the FM broadcast band, a short wave broadcast band (2.3 to 26.1 MHz), a VHF TV band (90 to 108 MHz, and 170 to 222 MHz), an UHF TV band (470 to 770 MHz), a VHF TV band in North America and Europe (45 to 86 MHz, 175 to 225 MHz), a 800 MHz band for automobile telephone (810 to 960 MHz), a 1.5 GHz band for automobile telephone (1.429 to 1.501 GHz), a UHF band (300 MHz to 3 GHz), a frequency band for GPS (Global Positioning System, 1575.42 MHz for GPS signals from satellites) and a frequency band for VICS (Vehicle Information and Communication System).

The high frequency wave glass antenna according to the present invention may be used both as an antenna for the desired frequency band stated earlier and an antenna for at least one frequency band selected among a short wave broadcast band, a middle wave broadcast band (520 to 1700 kHz) and a long wave broadcast band (150 to 280 kHz).

In the present invention, the peripheral circuit 7 for the antenna may be provided as required. Examples of the peripheral circuit 7 for the antenna are an impedance matching circuit, a preamplifier circuit and a resonant circuit. There is no limitation to the type of the peripheral circuit for the antenna.

In the present invention, each of the primary antenna conductor, the power feeding point, the grounding conductor, the grounded point, the loop-forming conductor (s) and the auxiliary loop-forming conductor(s) may be normally prepared by printing paste containing electrically conductive metallic materials, such as conductive silver paste, on the interior side of the glass sheet for a rear side window and baking the printed paste. However, the present invention is not limited to this preparing method. Each of these members may be prepared by forming a linear or foil member made of electrically conductive material, such as copper, on the interior side or the exterior side of the glass sheet. Each of these members may be provided in the glass sheet.

EXAMPLES

Now, examples of the present invention will be described in detail, referring to some of the accompanying drawings.

Example 1

Figure 9:
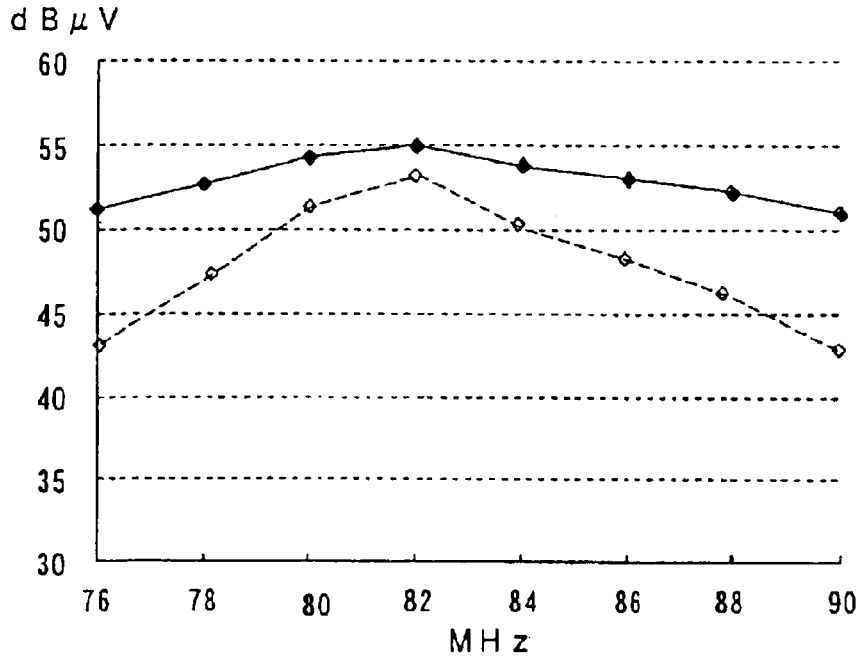
FIG. 9 is a graph showing sensitivity-frequency characteristics in the FM broadcast band in each of Examples 1 and 3.

A high frequency wave glass antenna, which was configured as shown in FIG. 4, was prepared on a glass sheet for a rear side window of an automobile. The glass antenna had the auxiliary loop-forming conductors 6*a*, 6*b* provided therein. The peripheral circuit 7 for the antenna was a preamplifier circuit. The amplification of the preamplifier circuit was +5.0 dB for the FM broadcast band. The dimensions and the constants of each of the members were listed below. The glass sheet 1 was one that was supposed to be provided on the left side of an automobile. The shown pattern is one that was seen from the interior side. The right side on this figure is nearer to the front end of an automobile. The sensitivity-frequency characteristics in the FM broadcast band at the output end of the preamplifier circuit are indicated by a solid line in FIG. 9.

| | |
|---|---|
| Maximum value of glass sheet 1 in vertical direction: | 380 mm |
| Maximum value of glass sheet 1 in transverse direction: | 400 mm |
| Maximum value of opening edge 2 in vertical direction: | 360 mm |

-continued

| | |
|---|---|
| Maximum value of opening edge 2 in transverse direction: | 380 mm |
| Conductor length of primary antenna conductor 3 (excluding power feeding point 3a): | 1080 mm |
| Conductor length of primary antenna conductor 3 from first portion 3c to second portion 3d: | 425 mm |
| Conductor length of primary antenna conductor 3 from portion 3e to second portion 3d: | 200 mm |
| Conductor length of primary antenna conductor 3 from portion 3e to leading edge 3b: | 450 mm |
| Conductor length of grounding conductor 4 (excluding grounded point 4a): | 725 mm |
| Conductor length of grounding conductor 4 from grounded point 4a to portion 4c (excluding grounded point): | 215 mm |
| Conductor length of grounding conductor 4 from portion 4c to portion 4d: | 345 mm |
| Conductor length of grounding conductor 4 from portion 4d to leading edge 4b: | 150 mm |
| Loop-forming conductor 5a: | 435 mm |
| Loop-forming conductor 5b: | 350 mm |
| Auxiliary loop-forming conductor 6a: | 360 mm |
| Auxiliary loop-forming conductor 6b: | 345 mm |
| Shortest distance between left portion of primary antenna conductor 3 and left portion of grounding conductor 4: | 2.0 mm |
| Shortest distance between lower portion of grounding conductor 4 and loop-forming conductor 5b: | 2.0 mm |
| Greatest distance between upper portion of primary antenna conductor 3 and auxiliary loop-forming conductor 6a: | 35 mm |
| Greatest distance between loop-forming conductor 5a and auxiliary loop-forming conductor 6a: | 35 mm |
| Greatest distance between lower portion of primary antenna conductor 3 and auxiliary loop-forming conductor 6b: | 35 mm |
| Greatest distance between loop-forming conductor 5b and auxiliary loop-forming conductor 6b: | 35 mm |
| Length of lead wire 9a: | 250 mm |
| Length of lead wire 9b: | 250 mm |
| Distance between power feeding point 3 and grounded point 4a: | 15 mm |
| Shortest distance between grounded point 4a and right portion of loop-forming conductor 5a: | 15 mm |
| Maximum dimensions of power feeding point 3a in vertical and transverse directions: | 30 × 15 mm |
| Maximum dimensions of grounded point 4a in vertical and transverse direction(s): | 30 × 15 mm |
| Distance between lower portions of grounding conductor 4 and loop-forming conductor 5b: | 2.0 mm |
| Distance between left portions of grounding conductor 4 and left portion of primary antenna conductor 3: | 2.0 mm |

Example 2

A high frequency wave glass antenna for an automobile was prepared so as to have the same specifications as the glass antenna in the Example 1 except that the distances of the capacitively coupled portions (the distance between the lower portion of the grounding conductor 4 and the loop-forming conductor 5*b*, and the distance between the left portion of the grounding conductor 4 and the left portion of the primary antenna conductor) were changed. Average sensitivity characteristics in the Japanese FM broadcast band with respect to distances between the capacitively coupled portions are shown in FIG. 11. The results shown in this figure reveal that when the distances between the capacitively coupled portions are not shorter than 8.0 mm, the coupled portions are effective in terms of capacitive coupling, and the sensitivity is abruptly increased.

Comparative Example 3

Figure 10:
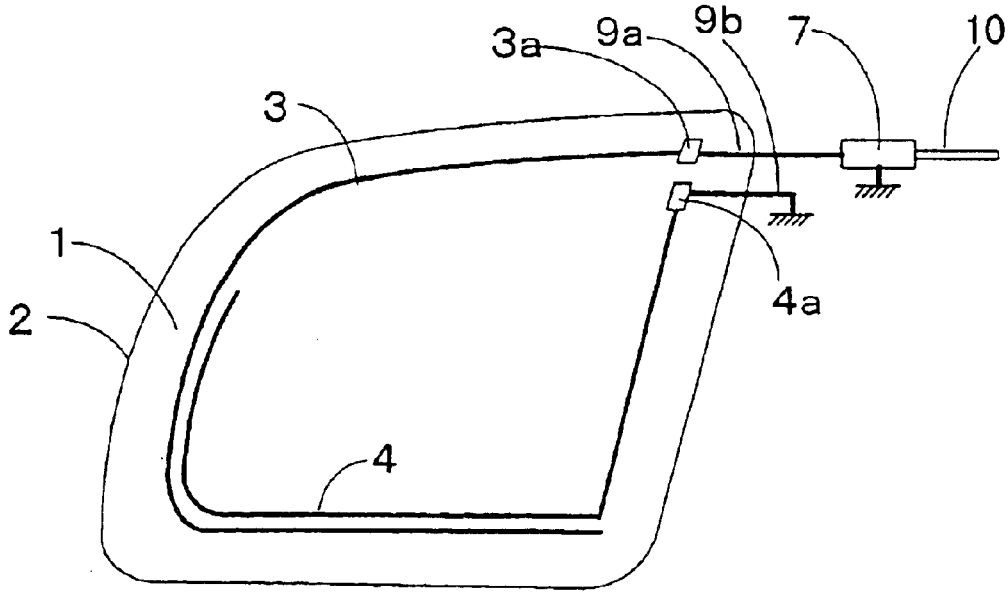
FIG. 10 is a schematic view of the high frequency wave glass antenna for an automobile in Example 3 as a comparative example.

A high frequency wave glass antenna, which was configured as shown in FIG. 10, was prepared on a glass sheet for a rear side window of an automobile. The dimensions and the constants of each of the members were listed below. The sensitivity-frequency characteristics in the FM broadcast band are indicated by a dotted line in FIG. 9. The preamplifier and the measuring conditions were the same as the ones in Example 1.

| | |
|---|---|
| Conductor length of primary antenna conductor 3 (excluding power feeding point 3a): | 1010 mm |
| Conductor length of grounding conductor 4 (excluding grounded point 4a): | 810 mm |
| Shortest distance between primary antenna conductor 3 and grounding conductor 4: | 2.0 mm |
| Distance between power feeding point 3a and grounded point 4a: | 15 mm |

Example 4

Figure 13:
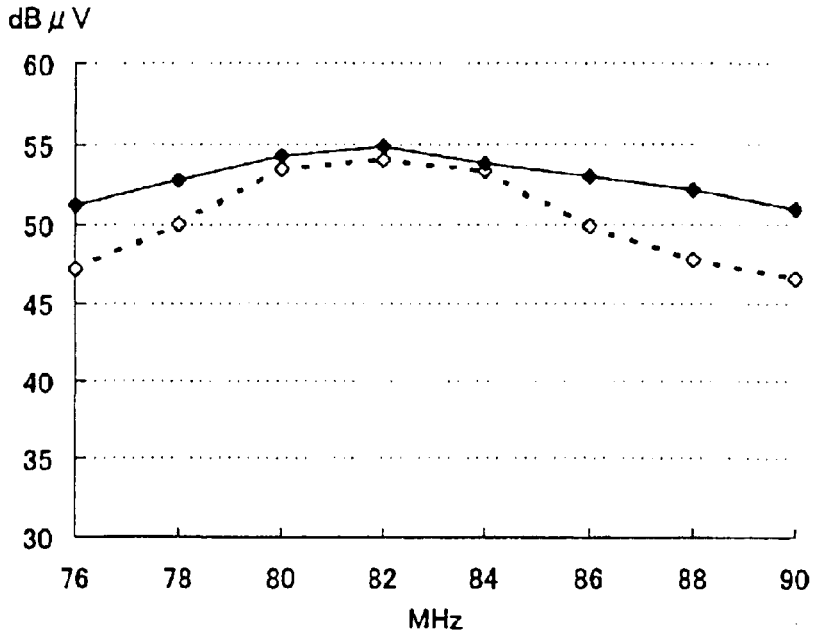
FIG. 13 is a graph showing sensitivity-frequency characteristics in the FM broadcast band in Example 4.

A high frequency wave glass antenna for an automobile was prepared so as to have the same specifications as the glass antenna in the Example 1 except that none of the loop-forming conductors 6*a*, 6*b* were provided. The sensitivity-frequency characteristics in the FM broadcast band are indicated by a dotted line in FIG. 13. For comparison, the sensitivity-frequency characteristics in the FM broadcast band in Example 1 are indicated by a solid line in FIG. 13.

Example 5

Figure 14:
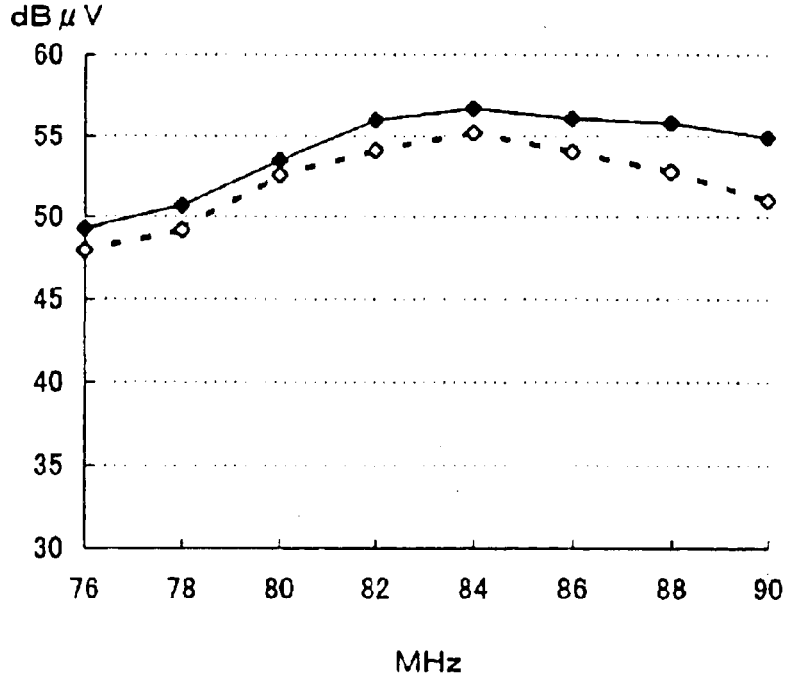
FIG. 14 is a graph showing sensitivity-frequency characteristics in the FM broadcast band in Example 5.

A high frequency wave glass antenna, which was configured as shown in FIG. 1, was prepared on a glass sheet for a rear side window of an automobile. The dimensions and the constants of each of the members were the same as the ones in Example 1. The sensitivity-frequency characteristics in the FM broadcast band are shown in FIG. 14. In FIG. 14, a solid line shows a case wherein the auxiliary loop-forming conductor 6*a* was provided, and a dotted line shows a case wherein the auxiliary loop-forming conductor 6*a* was not provided.

Example 6

Figure 15:
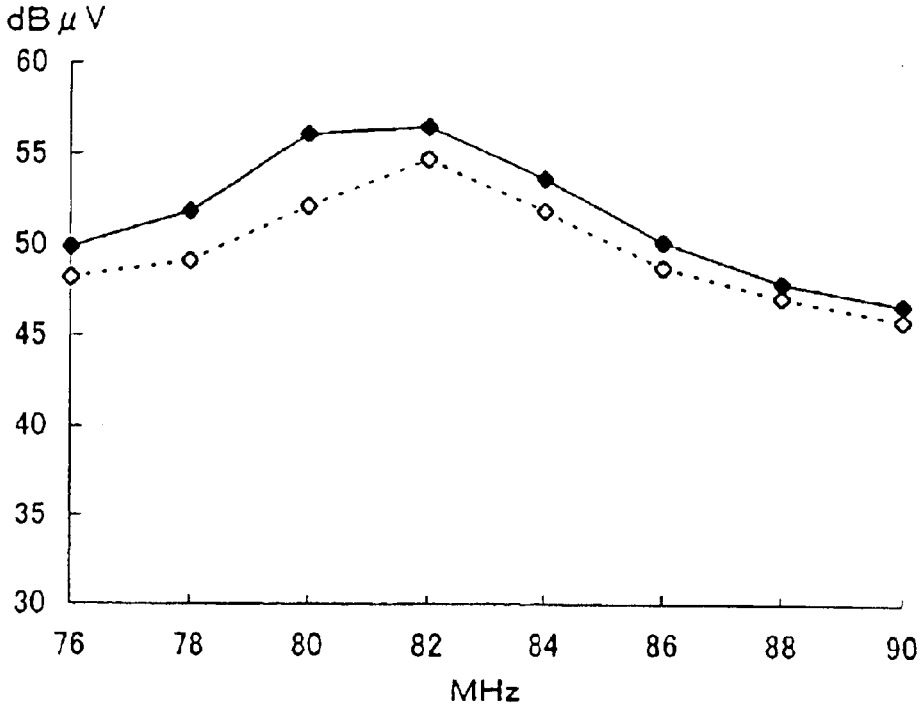
FIG. 15 is a graph showing sensitivity-frequency characteristics in the FM broadcast band in Example 6.

A high frequency wave glass antenna, which was configured as shown in FIG. 3, was prepared on a glass sheet for a rear side window of an automobile. The dimensions and the constants of each of the members were the same as the ones in Example 1. The sensitivity-frequency characteristics in the FM broadcast band are shown in FIG. 15. In FIG. 15, a solid line shows a case wherein the auxiliary loop-forming conductor 6*b* was provided, and a dotted line shows a case wherein the auxiliary loop-forming conductor 6*b* was not provided.

In accordance with the present invention, even when an attempt is made to increase the sensitivity to frequencies close to the center of the desired frequency band, the sensitivity to frequencies in at least one of the low range and the high range in the desired frequency band can be increased since the primary antenna conductor is provided with at least one loop conductor and since the primary antenna conductor is capacitively coupled with the grounding conductor. When the glass antenna according to the present invention is provided with the first loop conductor and the second loop conductor, it is possible to improve the flatness in the sensitivity to frequencies in the desired frequency band.

When the glass antenna according to the present invention is provided on or in the glass sheet of a side window so that none of the loop-conductor, the first loop conductor and the second loop conductor are provided in the B region, it is possible to ensure sufficient visibility.

The entire disclosure of Japanese Patent Application No. 2002-194886 filed on Jul. 3, 2002 including specification, claims, drawings and summary is incorporated herein by reference in its entirety.

What is claimed is:

1. A high frequency wave glass antenna for an automobile, comprising a primary antenna conductor, a grounding conductor, a power feeding point for the primary antenna conductor and a grounded point for the grounding conductor provided on or in a glass sheet of a window of an automobile;

wherein the power feeding point and the grounded point are provided so as to be located in the vicinity of a peripheral portion of the glass sheet or an opening edge formed in an automobile body;

wherein when seen from an interior side or an exterior side of the automobile, the primary antenna conductor extends in a counterclockwise direction, beginning at the power feeding point;

wherein two portions of the primary antenna conductor are connected by a loop-forming conductor to form a loop conductor by the primary antenna conductor and the loop-forming conductor, or a portion of the primary antenna conductor and the power feeding point are connected by a loop-forming conductor to form a loop conductor by the primary antenna conductor, the loop-forming conductor and the power feeding point; and wherein a portion or an entire portion of the grounding conductor is located near to and capacitively coupled with at least one of the primary antenna conductor, the loop-forming conductor and the power feeding point.

2. The glass antenna according to claim 1, wherein the loop-forming conductor is provided at a position, which is higher than a substantial center of the glass sheet in a vertical direction.

3. The glass antenna according to claim 1, wherein when the glass sheet is divided into three parts with equal intervals L in a vertical direction, and when the three parts are called an A region, a B region and a C region from top, the loop-forming conductor is not provided in the B region.

4. The glass antenna according to claim 1, wherein the loop conductor has a plurality portions connected by a single auxiliary loop-forming conductor or a plurality of auxiliary loop-forming conductors.

5. The glass antenna according to claim 1, wherein when seen from the interior side or the exterior side, the power feeding point and the grounded point are located in the vicinity of a right edge or an upper edge of the glass sheet, and the grounded point is located substantially under the power feeding point.

6. The glass antenna according to claim 1, wherein the loop-forming conductor is located at a position nearer to a center on the glass sheet than a portion of the primary antenna that forms the loop conductor.

7. The glass antenna according to claim 1, wherein the loop-forming conductor is located at a position nearer to the peripheral portion of the glass sheet than a portion of the primary antenna that forms the loop conductor.

8. The glass antenna according to claim 1, wherein the distance between a portion or an entire portion of the grounding conductor and a portion or an entire portion of the primary antenna conductor is set at 0.5 to 8.0 mm to capacitively couple the grounding conductor and the primary antenna conductor.

9. The glass antenna according to claim 1, wherein the grounding conductor extends in a clockwise direction, beginning at the grounded point.

10. A high frequency wave glass antenna for an automobile, comprising a primary antenna conductor, a grounding conductor, a power feeding point for the primary antenna conductor and a grounded point for the grounding conductor provided on or in a glass sheet of a window of an automobile;

wherein the power feeding point and the grounded point are provided so as to be located in the vicinity of a peripheral portion of the glass sheet or an opening edge formed in an automobile body;

wherein when seen from an interior side or an exterior side of the automobile, the primary antenna conductor extends in a counterclockwise direction, beginning at the power feeding point;

wherein two portions of the primary antenna conductor are connected by a first loop-forming conductor to form a loop conductor by the primary antenna conductor and the first loop-forming conductor, or a portion of the primary antenna conductor and the power feeding point are connected by a first loop-forming conductor to form a first loop conductor by the primary antenna conductor, the first loop-forming conductor and the power feeding point;

wherein two portions of the primary antenna conductor, which are not contained in the first loop conductor, are connected by a second loop-forming conductor to form a second loop conductor by the primary antenna conductor and the second loop-forming conductor; and wherein a portion or an entire portion of the grounding conductor is located near to and capacitively coupled with at least one of the primary antenna conductor, the first loop-forming conductor, the second loop-forming conductor and the power feeding point.

11. The glass antenna according to claim 10, wherein the power feeding point is provided higher than a substantial center of the glass sheet in a vertical direction;

wherein when seen from the interior side or the exterior side of the automobile, the primary antenna conductor is provided so as to extend, in the counterclockwise direction, to at least a lower side of the glass sheet substantially along the peripheral portion of the glass sheet or the opening edge, beginning at the power feeding point;

wherein the two portions of the primary antenna conductor that are connected by the first loop-forming conductor are located higher than the substantial center of the glass sheet in the vertical direction, or the portion of the primary antenna conductor that is connected to the power feeding point by the first loop-forming conductor is provided higher than the substantial center of the glass sheet in the vertical direction;

wherein the two portions of the primary antenna conductor that are not contained in the first loop conductor and that are located lower than the substantial center of the glass sheet in the vertical direction are connected by the second loop-forming conductor; and wherein a portion or an entire portion of the grounding conductor, which extends beginning at the grounded point, is located near to and capacitively coupled with at least one of a lower portion of the primary antenna conductor, the first loop-forming conductor and the second loop-forming conductor.

12. The glass antenna according to claim 10, wherein when the glass sheet is divided into three parts with equal intervals L in a vertical direction, and when the three parts are called an A region, a B region and a C region from top, none of the first loop-forming conductor and the second loop-forming conductor are provided in the B region.

13. The glass antenna according to claim 12, wherein when the glass sheet is divided into the three parts with equal intervals L in the vertical direction, and when the three parts are called the A region, the B region and the C region from top, the first loop-forming conductor is entirely provided in the A region, and the second loop-forming conductor is entirely provided in the C region.

14. The glass antenna according to claim 10, wherein the first loop conductor has a plurality portions connected by a single auxiliary loop-forming conductor or a plurality of auxiliary loop-forming conductors.

15. The glass antenna according to claim 10, wherein the second loop conductor has a plurality portions connected by a single auxiliary loop-forming conductor or a plurality of auxiliary loop-forming conductors.

16. The glass antenna according to claim 10, wherein the distance between a portion or an entire portion of the grounding conductor and a portion or an entire portion of the second loop-forming conductor is set at 0.5 to 8.0 mm to capacitively couple the grounding conductor and the second loop-forming conductor.

17. The glass antenna according to claim 10, wherein the primary antenna conductor has a conductor length between the first loop conductor and the second loop conductor ranging from $(1/4)\cdot(\lambda_M/4)\times K$ to $(1/2)\cdot(\lambda_M/4)\times K$, wherein a desired frequency band to be received has a center frequency $F_M$, the center frequency has a wavelength $\lambda_M$, and K is shortening ratio by glass.

18. The glass antenna according to claim 10, wherein the grounding conductor extends in a clockwise direction, beginning at the grounded point.

19. A high frequency wave glass antenna for an automobile, comprising a primary antenna conductor, a grounding conductor, a power feeding point for the primary antenna conductor and a grounded point for the grounding conductor provided on or in a glass sheet of a window of an automobile;

wherein the power feeding point and the grounded point are provided so as to be located in the vicinity of a peripheral portion of the glass sheet or an opening edge formed in an automobile body;

wherein when seen from an interior side or an exterior side of the automobile, the primary antenna conductor is provided so as to extend, in a counterclockwise direction, to at least a lower side of the glass sheet substantially along the peripheral portion of the glass sheet or the opening edge, beginning at the power feeding point;

wherein two portions of the primary antenna conductor are connected by a loop-forming conductor to form a loop conductor by the primary antenna conductor and the loop-forming conductor, or a portion of the primary antenna conductor and the power feeding point are connected by a loop-forming conductor to form a loop conductor by the primary antenna conductor, the loop-forming conductor and the power feeding point; and wherein a portion or an entire portion of the grounding conductor, which extends beginning at the grounded point, is located near to and capacitively coupled with at least one of a lower portion of the primary antenna conductor and the loop-forming conductor.

20. The glass antenna according to claim 19, wherein when the glass sheet is divided into three parts with equal intervals L in a vertical direction, and when the three parts are called an A region, a B region and a C region from top, the loop-forming conductor is not provided in the B region.

* * * * *